US008926406B2

(12) United States Patent
Mrak et al.

(10) Patent No.: US 8,926,406 B2
(45) Date of Patent: Jan. 6, 2015

(54) SURFACE APPLIED ABRASIVE CLEANING APPARATUS AND METHOD

(75) Inventors: Dusan Mrak, Anacortes, WA (US); Eric C. Hauge, Chico, CA (US); Peter L. Madonna, Federal Way, WA (US); Rick M. Tarver, Oklahoma City, OK (US)

(73) Assignee: Accelabrator Technologies LLC, Portland, OR (US)

( * ) Notice: Subject to any disclaimer, the term of this patent is extended or adjusted under 35 U.S.C. 154(b) by 792 days.

(21) Appl. No.: 13/010,749

(22) Filed: Jan. 20, 2011
(Under 37 CFR 1.47)

(65) Prior Publication Data

US 2011/0217907 A1 Sep. 8, 2011

Related U.S. Application Data

(60) Provisional application No. 61/336,471, filed on Jan. 21, 2010.

(51) Int. Cl.
*B24C 5/06* (2006.01)

(52) U.S. Cl.
USPC ..... 451/95; 451/97; 451/98

(58) Field of Classification Search
USPC ..... 451/38, 81, 89, 95, 97, 98; 134/6, 7
See application file for complete search history.

(56) References Cited

U.S. PATENT DOCUMENTS

| | | | | |
|---|---|---|---|---|
| 2,131,767 | A * | 10/1938 | Turnbull | 451/81 |
| 5,081,801 | A * | 1/1992 | Fylak | 451/97 |
| 5,417,608 | A * | 5/1995 | Elliott | 451/81 |
| 5,620,362 | A * | 4/1997 | Kuehn | 451/81 |
| 5,882,246 | A | 3/1999 | Inkyo et al. | |
| 8,062,095 | B2 * | 11/2011 | Voges et al. | 451/38 |
| 8,074,331 | B2 * | 12/2011 | Voges | 29/81.01 |
| 8,128,460 | B2 * | 3/2012 | Voges et al. | 451/38 |
| 2009/0186564 | A1 * | 7/2009 | Liedtke | 451/91 |
| 2011/0117824 | A1 * | 5/2011 | Loutzenheiser et al. | 451/97 |

FOREIGN PATENT DOCUMENTS

| | | |
|---|---|---|
| KP | 1019970001150 | 11/1999 |
| WO | WO-9427786 | 12/1994 |

OTHER PUBLICATIONS

International Search Report and Written Opinion from PCT/US2011/022043 mailed Nov. 17, 2011, 8 pages.
International Preliminary Report on Patentability from PCT/US2011/022043 mailed Aug. 2, 2012, 5 pages.

* cited by examiner

*Primary Examiner* — Eileen P. Morgan
(74) *Attorney, Agent, or Firm* — Blakely Sokoloff Taylor & Zafman

(57) ABSTRACT

A rotor assembly is provided for blast processing. The rotor assembly includes multiple lofting elements to create a vortex to loft particulate material to be used to process a target, and multiple elements to project the particulate material toward the target. The rotor assembly is enclosed within an operating chamber that has a target area into which the particulate material is projected to strike the target. There may further be angled deflectors at the opening to direct particulate material back toward the rotor assembly to use the material for further processing. Certain components are easily adjustable for different sizes and shapes of target. The action of the rotor assembly enables the use of up to 100% pure grit for entire cleaning processes, and provides single pass hook profile on any common material surface.

18 Claims, 7 Drawing Sheets

SURFACE APPLIED ABRASIVE CLEANING APPARATUS AND METHOD

RELATED CASES

This application is a non-provisional of, and claims the benefit of priority of U.S. Provisional Patent Application No. 61/336,471, filed Jan. 21, 2010.

FIELD

Embodiments of the invention are related generally to abrasive processing of a target, and embodiments of the invention are more particularly related to abrasive processing by use of particulate material.

COPYRIGHT NOTICE/PERMISSION

Portions of the disclosure of this patent document may contain material that is subject to copyright protection. The copyright owner has no objection to the reproduction by anyone of the patent document or the patent disclosure as it appears in the Patent and Trademark Office patent file or records, but otherwise reserves all copyright rights whatsoever. The copyright notice applies to all data as described below, and in the accompanying drawings hereto, as well as to any software described below: Copyright© 2011, Accelerator Technologies, LLC, All Rights Reserved.

BACKGROUND

Abrasive cleaning and processing of material is frequently used as a preparatory step to prepare the surface of a material (typically metal) for other processing such as sealing and/or painting, or simply cleaning and renewing a surface. Abrasive cleaning or processing is commonly referred to as blast cleaning or blast processing, and the terms are used interchangeably herein. In general, abrasive cleaning or blast cleaning involves applying accelerated particulate materials against a surface to be cleaned. Blast cleaning can be effective in removing any existing paint, dirt, grease, oil, rust, or other surface contaminant from a target to provide a cleaned surface.

Traditionally, blast cleaning has been performed through the use of sand, grit, or other particulates as the blasting medium. The two traditional approaches to accelerating the blasting medium include either propelling it at high velocity with pneumatic means, or projecting it via mechanical means.

Use of pneumatic means is often referred to as "air blasting", even though liquid can be used in addition to or in place of air as the propellant. Air blasting can be accomplished via suction or pressure. Suction systems use a vacuum to draw media into the air stream. Pressure systems feed media directly into a pressurized air stream that accelerates it toward the surface to be blasted. Wet blasting propels blast media in liquid suspension onto the surface to be cleaned.

The most common mechanical means is wheel blasting, where abrasive particulate matter is projected against the target surface through the use of a rapidly rotating centrifugal wheel. Wheel blasting machines typically have one or more blast wheels each having a multiple blades extending radially from the wheel. The size of the wheel blast machine and the number and power of the blast wheels vary considerably depending on the targets to be blasted as well as on the expected result and efficiency. The blast wheel is mounted in a housing and is rotated at high speed. Abrasive such as steel shot is fed onto the blades and is projected against the target surface. The impact of the abrasive with the target dislodges paint, rust, and other debris from the surface.

The equipment and methods of traditional systems are subject to a variety of deficiencies. The primary concern is that the systems cannot provide the desired finish in a single pass, or a single processing of the target. The metal condition and finish specifications are linked. The condition of the metal (i.e., the amount of scale, rust, or corrosion and the desired surface profile specification) determines the amount of blast material and the length of blasting time required to achieve the desired outcome.

The surface profile specification is based on the depth of the target's surface cross-section versus the thickness of the applied finish. The Steel Structures Painting Council (SSPC) for surface cleaning quality has set standards. As an example: "white metal blast cleaning" means that the target should be free of all visible rust, mill scale, paint, and foreign matter.

However, traditional systems either use mixtures of shot and grit that create a dimpled or peened surface profile, and/or require additional processing to achieve the desired surface profile.

A dimpled or peened surface profile does not have the necessary surface qualities for coatings to adhere. Such a profile is in contrast to the higher quality "anchor profile" that allows good coating adherence. An additional problem may exist in creating a surface that traps contaminants by shattering the mill scale rather than removing it. Such a peened surface results in the edges around the dimple rotting over and trapping mill scale. Trapping milt scale during the abrasive cleaning is referred to as "non-visual contamination". Painting or coating over non-visual contamination results in accelerated failure of protective coatings due to the accelerated formation of corrosion.

Additional processing is typically used to compensate for the inability of traditional machines to provide the desired surface. The additional processing can either be additional, labor intensive, manual open blasting processing (for example, pneumatic (such as sandblasting) using a manually operated hand held nozzle) to achieve the desired angular profile after the mill-scale is removed.

A related problem is that traditional machines typically only prepare one side of a steel plate, pipe, or other target at a time, and then must be turned over for the process to be repeated. The alternative of running the target through a centrifugal/wheel blasting machine two or more times (at least once for each side) has a number of disadvantages. Typically, wheel blasting machines must use a combination of grit and shot, and the combination leaves a significant variation in the plate surface. Surface variation develops because there is a predisposition for the grit to clump together and separate from the shot. Also, even when used with shot, the use of grit produces accelerated wear on the internal components of the machine. The increased wear requires increased and more frequent maintenance, which increasing operating costs and reduces efficiency.

In addition to the problems described above, traditional wheel blasting and pneumatic blasting machines are generally configured for a fixed size target. There are typically no easy adaptations for use in the treating of a range of sizes of pipe or other target shape. Additionally, traditional equipment produces a tendency for abrasive particles to drop out of circulation and collect in various portions of machines and external environments, which reduces recovery of the abrasive medium and reduces overall performance efficacy.

Most conventional centrifugal wheel blast operations are "open" systems requiring a collection pit for used media. Gravity is often used to deposit used media into the collection pit after it has impacted the surface. Attempts have been made to reuse the material more effectively, which generally includes some combination of augers, brushes, scoops, elevators, and/or other collection and transport means to move the media from the collection pit to the feed hopper to be recirculated.

One previous system, as described in U.S. Patent Application Publication No. US 2003/0064668 A1, describes a rotor system that attempts to create a vortex to continually recycle particulate material. However, that system as described is subject to multiple failures, and does not provide a functional machine for industrial use. One particular problem is that of breaking down of the machine, and not keeping the blast medium particulates in circulation as desired.

BRIEF DESCRIPTION OF THE DRAWINGS

The following description includes discussion of figures having illustrations given by way of example of implementations of embodiments of the invention. The drawings should be understood by way of example, and not by way of limitation. As used herein, references to one or more "embodiments" are to be understood as describing a particular feature, structure, or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive.

Figure 1:
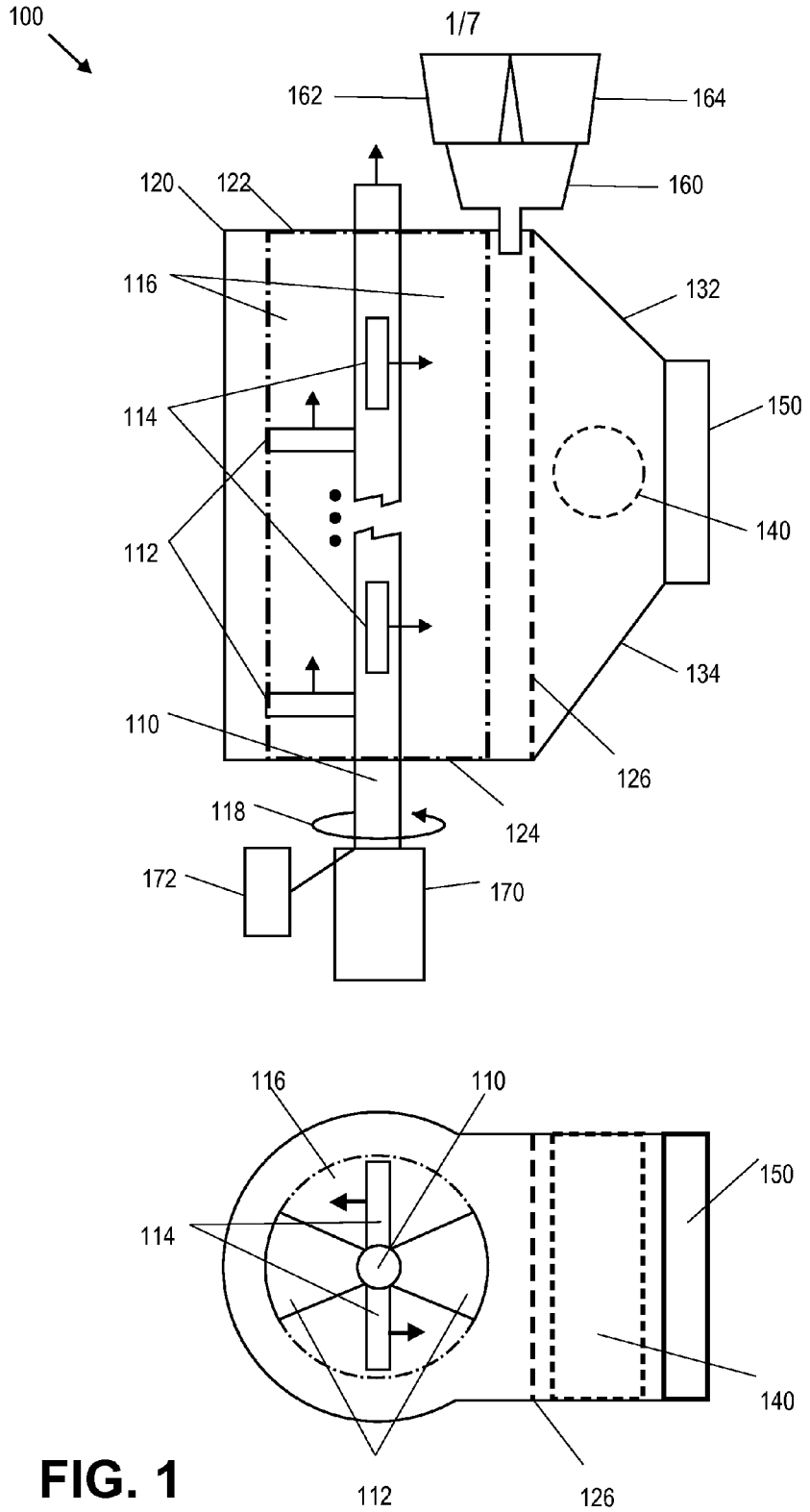
FIG. 1 is a block diagram of side and top views of an embodiment of a system to provide abrasive processing or cleaning of the surface of a target.

Descriptions of certain details and implementations follow, including a description of the figures, which may depict some or all of the embodiments described below, as well as discussing other potential embodiments or implementations of the inventive concepts presented herein. An overview of embodiments of the invention is provided below, followed by a more detailed description with reference to the drawings.

DETAILED DESCRIPTION

As described herein, a blast system includes a rotor assembly to project blast material. In one embodiment, the rotor assembly further has associated angled deflectors for blast processing or cleaning. The rotor assembly includes multiple lofting elements and impelling elements. The lofting elements are to create a vortex to loft particulate material to be used to process a target. The impelling elements are to project the particulate material toward the target. The rotor assembly is enclosed within an operating chamber that has a target area into which the particulate material is projected to strike the target. In one embodiment, there are further angled deflectors at the opening to direct particulate material back toward the rotor assembly to use the material for further processing. Certain components are easily adjustable for different sizes and shapes of target. The action of the rotor assembly enables the use of up to 100% pure grit for entire cleaning processes, and provides single pass hook profile on any common material surface.

The target area can be considered an opening in the walls of the operating chamber. Particulate material projected to other areas of the operating chamber will deflect off the walls and be cycled back into the vortex. However, particulate material projected into the target area is projected outside the vortex, and requires something other than the operating chamber walls to cycle it back into the vortex. Thus, the particulate material can be said to be projected through an opening, and the operating chamber can be said to have an opening because particulate material sent into the target area is not deflected by an operating chamber wall, and would go outside the vortex if not for some other mechanism to deflect it back. Some of the material will rebound off the target and fall back into the vortex. However, to cycle all (or substantially or mostly all) of the particulate material back into the vortex, angled deflectors are positioned at the target area to deflect particulate material back into the operating chamber to be further lofted into the vortex and be subject to further projection.

Additionally, the rotor components are made of material that has a harder composition than the blast medium particulates. Thus, the machine does not suffer mechanical failure due to extended use as the machine referenced above of Publication No. US 2003/0064668 A1. Therefore, as described herein, a blast system has the durability to enable the vortex method described herein, and provides for a mechanism to re-introduce the particulate material back into the vortex to keep the process running. Additional advantages are described below.

As described herein, a system is provided that is capable of automated media blasting for surface cleaning. The vortex created and sustained as described herein enables preparing all sides of steel or other plate material, work pieces, steel or other pipe, beams, parts or work pieces with a desired surface profile in one pass or a single process.

Reference is made above to a target area or an opening in a blast chamber or operating chamber wall. Another way to look at the system is that a perimeter portion of the operating chamber is positioned against or positioned to receive the target work surface. Depending upon the relative sizes of the operating chamber and the target surface, the target may be secured inside the target area, or may be progressively passed through the target area for processing. For material such as pipe, structural beam (I-beam, H-beam, box beam, angle iron, or other beam), sheet, or plate, the blast chamber may be equipped with seals adjacent the material entry and exit points of the blast chamber. Such seals may be of bristle brush or other suitable materials understood by those skilled in the art.

As the rotor assembly rotates at a relatively high number of rotations per minute (e.g., somewhere in the range of 3000-4000 rpm), the rotor assembly creates a vortex along the axis of rotation. As particulate material is directed into the operating chamber, it is brought into the vortex, and contacts a rotor-impeller assembly within the blast chamber and projects the particulate media toward the target area where the target is bombarded by the particulates.

As the particulate media rebounds from the target surface back into the blast chamber, the particulates rebound off the interior surfaces of the chamber to again contact the rotor-impeller surfaces and be directed repeatedly against the work surface to be cleaned. Some of the particulate material is deflected back to the rotor assembly for reuse. Thus, at least a portion of the particulate media strikes an angled deflector to direct the particulate back into the operating chamber and the vortex created in the operating chamber.

As used to herein, a vortex refers to a swirling column of air. The vortex is created along the longitude of the axis that has the rotor assembly. The vortex creates an upward swirling movement of air sufficient to loft the particulate material to be directed away from the vortex by the impellers. Angled deflectors positioned at the target area, substantially adjacent to the target itself, direct particulate material back to the vortex.

The constant reuse and lofting of particulate material provides for better performance. Grit does not have the same tendency to collect in internal components of the system described herein as it does in wheel blasting machines, which means more grit can be in the machine at any given time, and the grit can be recirculated for a longer period of time. In one embodiment, the particulate material is 100% grit material. A particulate composition of 100% it is not achievable in traditional systems, especially under the duration of continuous use provided by the system described herein.

The hardness and density of the impeller-assembly material also affects durability and functioning of the equipment. In one embodiment, one or more of the internal components of the blasting system described herein includes at least a portion of manganese in their composition. There are known manganese alloys that can provide the desired durability, or nearly pure manganese may be used, or metal parts can be coated in manganese or manganese alloy. Besides manganese, other materials of comparable harmless/durability can be used. Components having manganese in their compositions may include the lofting deflectors, the impellers, the angled deflectors, and/or portions of the operating chamber walls.

In addition to the other advantages provided by the system described herein, the system can also provide for easy removal and replacement of components to adjust for different sizes and shapes of the target, or to replace components due to wear. For example, in one embodiment, the angled deflectors are removably connected to the operating chamber, and can be switched out for different size targets or for replacement due to wear. Additionally, the seals used to prevent loss of particulate material out of the system during use can be switched out for different sizes and shapes of target. Thus, the system can provide a closed environment where particulate material is automatically retained and re-circulated.

FIG. 1 is a block diagram of side and top views of an embodiment of a system to provide abrasive processing or cleaning of the surface of a target. Device 100 is a machine that provides blast processing as described herein. Shaft 110 provides a mechanism to which components can be connected and rotated. Shaft 110 is an axis for a rotor assembly, and is the axis around which lofting deflectors and impellers are rotated. The arrow point out the end of shaft 110 indicates the direction the shaft or the axis "points". In reference to creating a vortex, the lofting deflectors create a vortex along shaft 110 in the direction indicated.

Shaft 110 has multiple lofting deflectors 112 and multiple impellers 114 attached. The combination of the shaft, lofting deflectors and impellers can be referred to as a rotor assembly. It will be understood with reference to device 100 that components are not shown to scale, and certain components are intentionally exaggerated with respect to a practical system for purposes of illustration and discussion. It will also be understood that shaft 110 is illustrated with a "break" and there is an ellipsis to indicate that the number of lofting deflectors 112 and impellers 114 is variable. In one embodiment, the internal size of the device is configured based on an adjustment to a number of lofting deflectors and impellers, a size and configuration of angled deflectors, and a configuration of at least a top or bottom portion of the enclosure.

Lofting deflectors 112 have arrows that point in a direction of the face of the lofting deflectors. It will be observed that the faces of lofting deflectors 112 point substantially parallel to a longitude of shaft 110. It could also be described as that the faces of lofting deflectors 112 point perpendicular to a place in which they are rotated. It will be understood that the faces can be exactly perpendicular to the longitude of shaft 110, or can be slightly off perpendicular. As lofting deflectors 112 are rotated to create a vortex of air along the longitude of the axis. In one embodiment, the creation of the vortex is a combination of the movement of the lofting deflectors and the impellers, with lofting deflectors 112 deflecting particulate material "up" to allow it to be struck or otherwise driven by impellers 114.

Impellers 114 are attached to shaft 110, and have faces that point in a direction that is circumferentially forward facing. Arrow 118 indicates a direction of rotation of shaft 110. As shaft 110 rotates, impellers 114 will move around, and at every instant in the rotation, the face of each impeller 114 will point in a perpendicular tangent relative to the circular motion in which the impeller is moving. The direction of the face is thus circumferentially forward facing because the face always points along the circumference of a circle of motion the impeller moves relative to the direction of rotation 118.

Impellers 114 project the particulate material away from shaft 110, generally along a tangent of the circular motion of the impellers. The motion of the particulate material away from shaft 110 is similar to that of centrifugal motion. The movement of the particulate material may be via launching the material due to centrifugal force (i.e., the particulate material is flung off the impellers due to the angular momentum) and/or the movement of the particulate material may be due to being struck by impellers 114. Thus, the impellers projecting the particulate material may be via ejecting the material due to centrifugal force, or due to striking the particulate material, or a combination.

The view of device 100 at the top of FIG. 1 is a simplified side view, where the target area is to the right of line 126, referring to the left and right orientation of FIG. 1. The view of device 100 at the bottom of FIG. 1 is a simplified top view, showing lofting deflectors 112 on either side of shaft 110, as well as impellers on either side of shaft 110. As shown in more detail later, in one embodiment, there may be one impeller 114 for each lofting deflector, and the lofting deflector and the impeller are part of a single assembly or subassembly. Additionally, similar to what is suggested in FIG. 1, the faces of lofting deflectors 112 may be perpendicular to the faces of impellers 114.

Device 100 includes operating chamber 120, which includes walls (or is formed by walls) that enclose the rotor assembly of shaft 110 with lofting deflectors 112 and impellers 114. Within operating chamber 120, area 116 is the general area in which the lofting deflectors and impellers will rotate. Thus, area 116 is the general area in which the vortex is created. The walls of operating chamber 120 may be closer to vortex area 116 than what is depicted, and it is expected that in practice the vortex will reach somewhat outside the physical dimensions of the rotor assembly (in contrast to what is depicted in the simple illustration of FIG. 1). Thus, operating chamber 120 encloses the rotor assembly and the vortex along the longitude of shaft 110 with the walls. The operating chamber is further enclosed with top portion 122 and bottom portion 124. The positioning of the top and the bottom portions determines a vertical size of the operating chamber from a base of the rotor assembly to a top of the rotor assembly. In one embodiment, at least one of the top or the bottom portions is adjustable to configure a vertical size of the operating chamber.

As mentioned above, the number of lofting deflectors and impellers can be adjusted, and the height of the rotor assembly and operating chamber may be correspondingly configured. The size of device 100, and in particular the height, may be adjusted for different sizes and/or shapes of target. In one embodiment, removably attachable seals and angled deflectors can also be configured to a size of the target, such as having seals with a size corresponding to the size and shape of the target.

Operating chamber 120 includes a target area opening 126 in the walls through which the particulate material is to be projected toward the target. In one embodiment, the target area may be generally enclosed by upper angled deflector 132 and lower angled deflector 134, along with walls of the operating chamber or extensions to operating chamber 120. In an embodiment where angled deflectors are not used, the target area is just outside the blast chamber. The target is inserted through target insertion point 140. Insertion point 140 is illustrated as a circle, which may be appropriate for certain targets (e.g., pipes), but not for other targets (e.g., plates). Device 100 further includes seal 150 at the "end" of the target area, or on the farthest side away from the vortex.

In one embodiment, insertion point 140 is closed up, and blast media is elected out the target area through seal 150 at a target outside of seal 150. Thus, in one embodiment, seal 150 is a combination of seal and opening. Thus, for example, operating configuration for plate processing may involve moving a target (e.g., a piece of plate steel) in front of seal and opening 150, or moving device 150 along a target (e.g., the hull of a ship).

In one embodiment, lofting deflectors 112 extend from an inner surface of blast chamber 120, until generally adjacent to the target or subject material, and aligned generally parallel with the perimeter of the target with the path the target through the blast chamber. Angled deflectors 132 and 134 are shaped and positioned to provide desirable turbulence patterns and deflecting surfaces that facilitate the dispersion and recycling of the projected media.

In one embodiment, a target that is inserted through insertion point 140 can be rotated and/or flipped within the target area demarked by line 126. Thus, surfaces on both sides of the targets can be processed in a single pass, or with a single processing cycle of the target through device 100. Such a one-pass effect can be achieved because of the configuration of device 100, when the media is accelerated to sufficient velocity to achieve the desired surface profile. In one embodiment, the media is repeatedly directed against the surface many times by the combined, synergistic operation of at least one rotor-impeller assembly and accompanying angled deflector or deflectors.

In one embodiment, only a single angled deflector is provided to direct blast media or particulate material back into vortex 116. In such an implementation, bottom deflector 134 would be preferred over upper deflector 132, seeing that particulate material would be more likely to be returned to a place inside operating chamber 120 that it can be recirculated by the rotor assembly.

It will be understood from the above discussion and from the simple illustration of device 100 that a "closed" system can be provided. Grit or other blast media is introduced into blast chamber 120 and is retained in the blast chamber throughout its period of utility. The blast media does not need to be collected and re-introduced into the system; rather, the operation of device 100 automatically recycles the blast media, allowing longer periods of continuous operation, and reducing cleanup and the need for peripheral components to facilitate media recirculation. Such closed operation is not possible in traditional systems.

Thus, device 100 does not require wasteful and dangerous collection pit and return feed mechanisms of traditional systems. Additionally, device 100 is capable of maintaining the media in the blast chamber in a state of recirculation throughout its span of use.

In one embodiment, particulate material to use as the blast medium is introduced from an opening in top portion 122. For purposes of illustration, entry mechanism 160 is illustrated, which may not look at all in the drawing as it would in a practical system. For example, a common approach would be to use tubing or piping to allow particulate material to flow down into operating chamber 120.

Elements 162 and 164 represent particulate material repositories that will be introduced into operating chamber 120. Particulate material can be introduced from only a single one of the repositories, or from both in combination. The combination can be controlled manually (e.g., how much material is placed in each), or mechanically (e.g., a switch, lever, or other mechanism may release material from a selected repository 162, 164). In one embodiment, repository 162 includes grit, which may be the main component on most processing applications. Repository 164 may include shot, which can be used on other applications, or can be used in combination with grit. As discussed above, the operation of device 100 is fairly agnostic to the use of grit or shot, seeing as both are processed in the same way, and the functioning of the machine prevents grit building up inside the operating chamber.

It will be observed that as illustrated in FIG. 1, entry mechanism 160 for introducing particulate material is ideally located just outside vortex area 116, or on the outer edge of vortex area 116. In this way, new material can be introduced while the device is in operation, and the material will typically fall to an area where the force of the vortex will draw it into the vortex. Such an indirect action is preferred over introducing it along shaft 110, which can introduce forces into the operation of the device that cause wobble and general wear on the device.

A motor is used to drive shaft 110 of device 1100. In one embodiment, motor 170 can be considered part of device 100. From another perspective, the motor is a peripheral device to enable the operation, but is not part of device 100 itself. Motor 170 is illustrated at a base of shaft 110, but can be alternatively mounted on an outer side of operating chamber 120, and drive shaft 110 from either the top or bottom of the shaft.

In one embodiment, dynamometer 172 is associated with device 100. Similar to the motor, dynamometer (commonly referred to simply as "dyno") 172 can be considered part of device 100, or peripheral to it. Dyno 172 is coupled to motor 170, and measures torque on the motor. Dyno 172 can indicate a torque on motor 170, or indicate when a torque for rotating the rotor assembly falls below a threshold value. Dynamometers of varying precision are available. However, in one embodiment, a simple current detection (which can be understood to fall within the dyno depicted) can be used to indicate a current drawn by the motor.

As the particulate material is recirculated, it will become finer and finer, until it is gradually less effective for its purpose of processing a target surface. The point of "less effective" will depend on a variety of factors dependent on implementation of device 100. For example, the rotations per minute (RPMs), particulate material size, motor, number of impellers in the assembly, and amount of particulate material may vary by implementation. However, the particulate material may need to be changed if the current drawn falls by approximately 25% or approximately 35%, or perhaps even more. Similar thresholds can be determined for torque.

It will be understood that as the particulate material is used, it breaks down finer and finer, until some of it becomes almost a dust, while other particles are simply smaller than they started. As the particulate material breaks down, the amount of torque required (and consequently the amount of current drawn) to rotate shaft 110 reduces. Thus, 172 can indicate when to change out the particulate material of device 100. The machine can be effectively operated until the threshold is reached.

White specific reference is made above to FIG. 1, in general, embodiments of the invention relate to a blast processing machine or device, where lofting deflectors and impellers create a vortex and project material at a target surfaced, and where an angled deflector adjacent to the target area deflects particulate material back toward the vortex for further processing.

The construction, design, and arrangement of the rotor assembly with impeller assembly or assemblies and lofting deflector or deflectors produce a continuous "lofting" effect within an operating chamber, enabling recirculation and redistribution of the blast media within the operating or blast chamber.

The prolonged lofting effect has long been sought after in the field. Despite many failed attempts at effective and affordable systems to provide prolonged lofting and repeated use of particulate media, current industry standards include mechanically complex, bulky, and/or expensive arrangements of additional equipment to gather, transport, and reintroduce particulate media into the blast chamber for use. For example, systems of augers, vacuums, conveyers, or other components have been used to try to mechanically move used particulate material. Such systems have also not provided good indication of when blast media is sufficiently "spent", apart from manual processes.

As described herein, a blast processing device achieves continuous lofting effect, keeping the blast media suspended and recirculating in the blast chamber to repeatedly direct the blast media against the work surface.

Blast cleaning, in general, relies primarily on mechanical forces to achieve cleaning performance. In order to blast clean, some form of media must be directed and "blasted" toward a surface. The mechanisms of delivery and types of media are wide and diverse and the possible combinations are many. The large portion of the effects of blasting is derived as a function of the kinetic energy delivered by the impacting media. Generally speaking, the kinetic energy of shot blast media may be considered as the kinetic energy anon-rotating rigid body. This kinetic energy is given by the equation: $(\frac{1}{2})mv^2$, where m=mass and v=velocity of the media.

As is understood regarding use and application of blast processing or blast cleaning, it is frequently performed as a preparatory step to remove existing paint, dirt, grease, oil, rust, or other surface contaminant to provide a cleaned surface, typically a metallic surface. The blast medium or particulate material is generally a range of different materials or a combination of them, from steel shot, steel grit, steel, to stainless steel cut wire shot, as is understood. The impact of the particulate material upon the target surface removes surface contaminants or coatings.

Steel abrasives are used to clean a wide variety of surfaces and parts, such as desanding and cleaning foundry castings, de-scaling metal sheet, billets, and profiles produced by the steel industry, and surface preparation prior to coating. Shot blasting equipment uses cast steel shot or grit, along with other types of abrasive media. It is used for metal cleaning, paint removal, rust removal, mill scale removal, sand, ceramic, or shell removal from die castings, steel, and iron castings or investment castings, metal surface preparation prior to painting or coating, automotive parts remanufacturing, and shot-peening for metal fatigue life and stress relief.

Steel abrasives are loose particles that are propelled at high velocities for blast cleaning or to improve the properties of metal surfaces. They are usually available in two different shapes ("shot" and "grit") that address different industrial applications. Steel shot refers generally to spherical grains typically made of molten steel through an atomization ("granulation") process, available in different sizes and hardnesses. Steel grit characterizes grains with a predominantly angular shape. These grains are typically obtained by crushing steel shot, and therefore exhibit sharper edges and broken sections as compared to shot. Grit is typically harder than steel shot, and is also available in different sizes and hardnesses.

The recyclability of steel shot and grit ranges between 2000 to 3000 cycles. Due to its high recyclability level, steel shot and grit tend to generate less waste when compared to other expendable abrasives. Steel shot or grit is usually available at different hardness levels, ranging between 40 and 65 on the Rockwell scale.

Steel shot and grit are used in cleaning applications for removal of material on metal surfaces. This type of cleaning is common in automotive industry (motor blocks, cylinder heads, and other parts).

Surface preparation is generally performed as a series of operations including cleaning and physical modification of a surface. Steel shot and grit are used in surface preparation process for cleaning metal surfaces which are covered with mill scale, dirt, rust, or paint coatings, and for physically modifying the metal surface such as creating roughness for better application of paint and coating.

Shot peening is the repeated striking of a metal surface by hard shot particles. These multiple impacts produce a deformation on the metal surface but also improve the durability of the metal part. The media used in this application is usually spherical rather than angular. The reason is that spherical shots are more resistant to the fractures that can occur from the striking impact.

Referring now to quality of the processed target surface, there are different grades of blasting effect achieved. A "White Blast" cleaning is the highest level of finish or cleanness to be achieved in industry. Existing centrifugal wheel-shot blast can achieve a White Blast; however, shot peening cannot achieve an "anchor" or "hook" profile. An "anchor" or "hook" profile provides for optimum adherence of protective coatings and paints. A desired effect for any blasting machine is to achieve a consistent White Metal Blast finish (SSPC SP-5/NACE NO 1) with up to a 5 mil anchor profile. The device described herein achieves such a finish and profile at a rate that greatly surpasses the results of either shot blasting with manual open grit blasting combined, or open grit blasting by itself.

Figure 2:
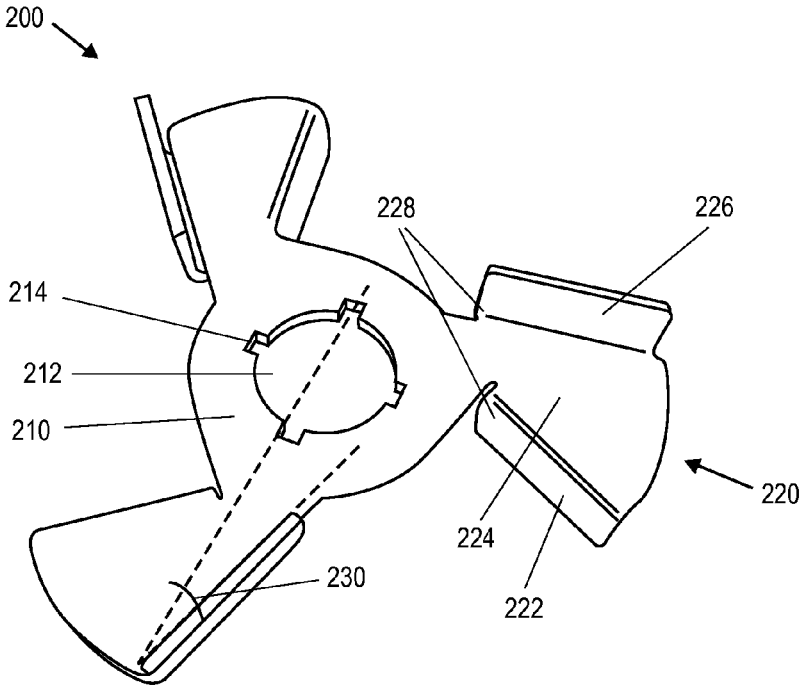
FIG. 2 illustrates an embodiment of a rotor element having a lofting portion and a striking portion.

FIG. 2 illustrates an embodiment of a rotor element having a lofting portion and a striking portion. Rotor element 200 illustrates an element of a rotor assembly as described herein. It should be noted that rotor element 200 is "upside down" relative to how it would be incorporated into a rotor assembly. Thus, the view is the "bottom" of the element.

Rotor element 200 has a central portion 210 that provides the basic structural attachment for the lofting portions and the impeller portions. Space 212 provides a space through which a shaft or axis of a rotor assembly pass. In one embodiment, space 212 includes notches 214 to engage rotor element 200 with a shaft. The notches may be interlocking keys, grooves, ribs, projections, and/or recesses that mate to corresponding structures on a shaft.

Rotor element 200 is illustrated with three arms 220, but may be constructed with more or fewer arms. Arm 220 includes impact member or impeller 222, lofting deflector 224 (the bottom face of the lofting deflector is seen), and member 226. Impeller 222 extends radially outward from center portion 210, and thus would extend radially outward from a shaft or axis of rotation. Impeller 222 has a circumferentially forward facing surface (hidden from view in rotor element 200), which faces back across the face of lofting deflector 224.

Member 226 may also be considered from one perspective as an impact member, but in one embodiment, it wilt generally not impact and project blast material. The reason member 226 does not project blast material, per se, in one embodiment is that member 226 provides a connection surface to another rotor element, which will have a back face of an impeller connected to member 226 (see FIGS. 4B and 5). Thus, in one embodiment a rearward facing edge of impeller 222 is made integral with an edge of another rotor element (a corresponding member 226). In one embodiment, rotor element 200 could be "free standing" and member 226 would operate as an impact member. Joints 228 connect the "vertical" portions of members 222 and 226 to the otherwise planar rotor element. In one embodiment, joints 228 are made at right angles.

It will be understood that while the surfaces or faces of impeller 226 and lofting deflector 224 are shown as generally planar, in different configuration they could include open spaces, gaps, slots, holes, dimples, bumps, or other features. Additionally, or alternatively, there could be curvature to either or both of impeller 222 or lofting deflector 224.

Also illustrated is angle 230 formed by two lines. The first is a line passing through the center point of rotor element 200 (i.e., the line would encompass a radius of rotor element from the center to an outer edge of a lofting deflector at the joint with a connecting member (such as 226). A second line is drawn as an extension of a horizontal line drawn through the plane of the blade of the connecting member. In one embodiment, angle 230 is approximately 15 or 16 degrees. Thus, the radially outward end of each impact member is positioned forwardly of the radially inward end portion in a circumferentially forward direction. It will be understood that an angle of 15 or 16 degrees is only one illustration, and the angle could vary, for example, by 1 degree increments somewhere between 0 and 30 degrees, such as 5-25 degrees, 10-20 degrees, or some other range, or some value between these ranges.

Figure 3:
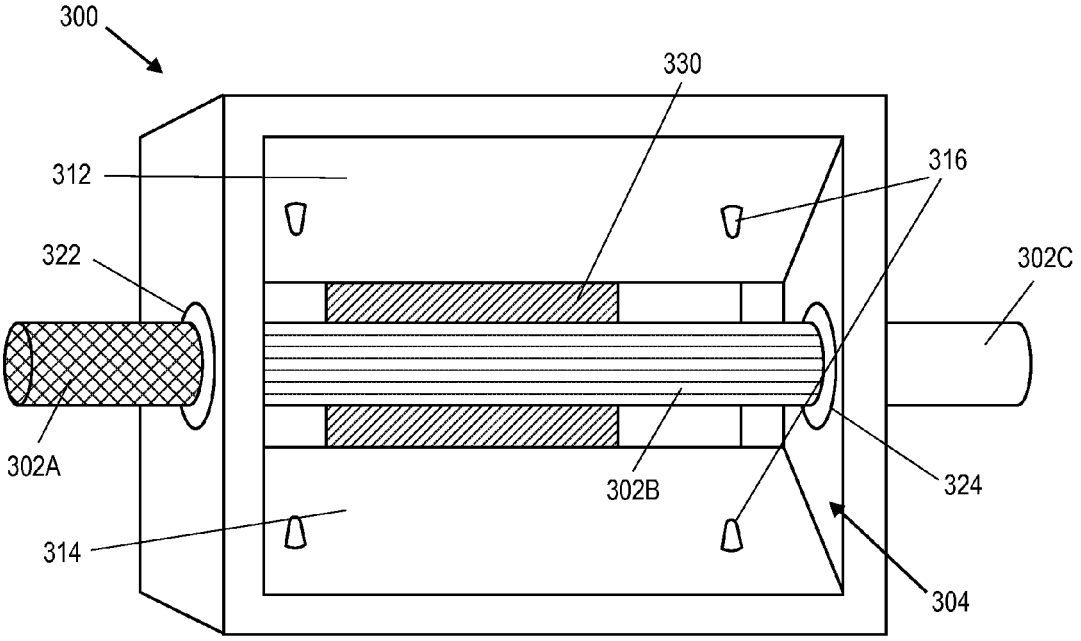
FIG. 3 illustrates an embodiment of an opening through which particulate material is projected from a blast chamber.

FIG. 3 illustrates an embodiment of an opening through which particulate material is projected from a blast chamber. Subassembly 300 illustrates elements of a blast processing machine that provide target area 304 as discussed above. The target area can mean different things depending on the work surface. For example, an example target 302 (with sections 302A, 302B, and 302C) is illustrated, and could be a pipe or a beam. Target 302 passes through target area 304 marked by the open space between top angled deflector 312 and bottom angled deflector 314.

Target area 304 can be considered to be just outside the peaked edges of angled deflectors 312 and 314 (i.e., the space beyond them, going into the page as seen from FIG. 3) for plate or other generally vertical and relatively planar surfaces. Planarity in the sense of a target is made in reference to the fact that a curvature of target surface is small or gradual relative to the opening between angled deflectors 312 and 314. Given the ability to adjust rotor assembly size and blast machine device size (including angled deflector size), most typical surfaces could be accommodated by some device configuration.

Thus, the target could be item 330 shown in FIG. 3. Alternatively, as discussed in more detail with reference to FIG. 7 below, item 330 could represent an opposing rotor assembly in a side by side facing blast processing devices configuration. In general, surface treatment of various targets is provided, such as diameter pipes, sheets, plates, beams, components, fittings, and a wide range of other objects. By surface treatment it is meant to describe techniques such as blast cleaning, shot blasting, peening, abrading, or other processing.

To the extent the deflectors deflect particulate material back into the vortex, they may be called 'lofting deflectors', but to clarify, angled deflectors 312 and 314 are stationary during operation of the blast machine, and do not technically contribute to the creation of an upward swirling vortex. Thus, they are more properly referred to as angled deflectors, and only those moving surfaces on the rotor elements referred to as lofting deflectors. The angled deflectors direct projected blast material back into the vortex (which would be positioned right in front of the view of assembly 300 as seen in FIG. 3).

Returning to the example of target 302, portion 302A represents a portion of the target that has not yet entered the target area for processing. It is indicated in an unfinished state by darker cross-hatching. Portion 302B represents a portion of the target that is being processed and is in target area 304, and is shown with minimal cross-hatching. Portion 302C represents a portion of the target that is fully processed and has exited the machine or exited target area 304. Means such as a conveyor system (not shown) can move target material along through the processing device.

Target 302 enters the target area via entry 322, and exits the target area via exit 324. Each of entry 322 and exit 324 may include a seal or other protective material to prevent blast material from ejecting outside target area 304.

In one embodiment, angled deflectors 312 and 314 extend from an inner surface of the blast chamber, until generally adjacent to subject material to be processed. The deflectors can be aligned generally parallel with the perimeter of target 302 the path of the target through target area 304. Angled deflectors 312 and 314 are shaped and positioned to provide desirable turbulence patterns and deflecting surfaces that facilitate the dispersion and recycling of the projected media.

In one embodiment, angled deflectors 312 and 314 are generally planar. In an alternate embodiment, one or both of angled deflectors 312 and 314 may be arcuate or concave or convex in cross section. Thus, they may be curved along their length or width or both to provide proper deflection of particulate material back into the vortex of the blast chamber. Angled deflectors 312 and 314 may extend across a portion or all of the opening of a blast chamber to allow for a variety of material sizes to be cleaned.

Angled deflectors 312 and 314 may be permanently installed or incorporated into the construction and design of a blast chamber. In one embodiment, the angled deflectors are releasable or removably affixed within target area 304 of a blast chamber to provide ease of replacement or adjustment. Securing means 316 are provided to secure the angled deflectors, and may allow for easy removal. Examples of securing means 316 can include threaded studs or bolts, nuts, brackets, clips, rails, tabs, or other affixing or securing means. Thus, angled deflectors can be adjustable for size, shape, curvature, or other variation in target material.

In one embodiment, a pair of lofting deflectors is provided for each rotor assembly. Angled deflectors extending laterally across the opening of the blast chamber, adjacent to the target, and oriented generally tangentially perpendicular to the rotor assembly axis of rotation (and parallel to the path of the target) have proven very effective. Planar deflectors may be oriented and secured to provide an angle of between 30 and 60 degrees, such as approximately 45 degrees, relative to the rotor assembly axis of rotation, along a plane passing through the path of the target. Depending upon the size and shape of the target, other lofting deflector configuration incorporating arcuate or complex curved surfaces, or other planar angles may provide better results. While generally smooth surfaces have proven effective for angled deflectors 312 and 314, dimpled, grooved, ridged, wavy, stepped, or other varying surfaces may be utilized.

In practice, the particulate media may strike one or more angled deflector after impacting the target, or the media may strike the angled deflector after being projected by a rotor assembly. Angled deflectors 312 and 314 are designed to redirect the particulate media toward the target and/or rotor assembly. In so doing, the lofting deflector may be positioned to significantly reduce the amount of blast media expelled from the blast chamber while providing and maintaining desired lofting and recycling of media, enabling more efficient surface cleaning and greatly reduced costs of operation.

Figure 4A:
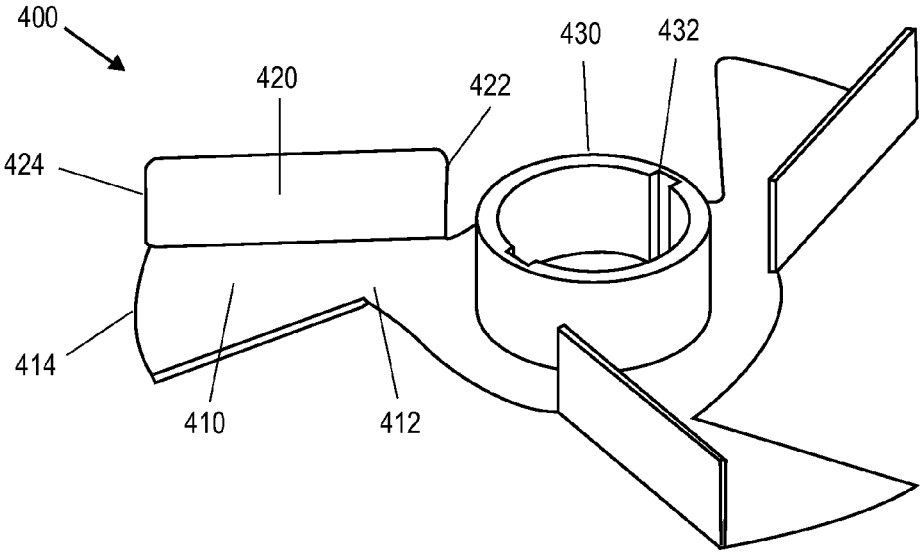
FIGS. 4A and 4B illustrate an embodiment of rotor elements that connect in an assembly with spacers.
Figure 4B:
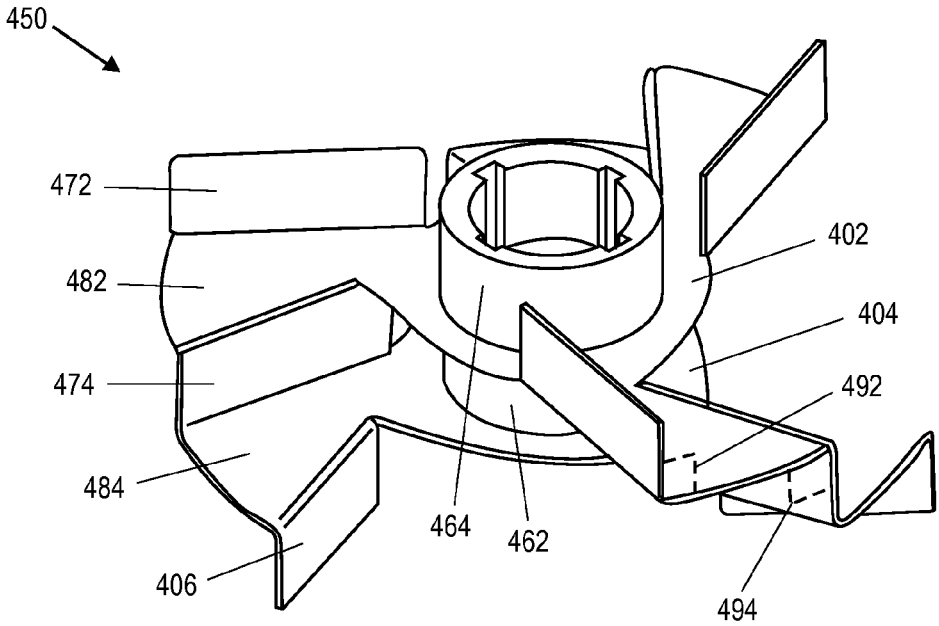

FIGS. 4A and 4B illustrate an embodiment of rotor elements that connect in an assembly with spacers. Subassembly 400 includes a rotor element consistent with what is described in FIG. 2, and spacer 430. Spacer 430 may include one or more grooves, notches, or other structures 432 to connect to a mating structure on a shaft. It will be understood that white shown with a particular configuration, and designed to rotate counter-clockwise, a mirror image element could be created to rotate clockwise. In either case, impeller 420 would be made to be circumferentially forward facing, referring to the direction in which the rotor element rotates during operation.

Similar to what is previously described, in the embodiment shown rotor element 400 includes three arms or impeller units. Each impeller unit includes impeller impact member 420, with radially inward end portion 422, and radially outward end portion 424, and upper and tower edges. Impeller 420 has a circumferentially forward facing impact surface. Lofting deflector 410 provides a lofting function, and is also a support member for the impeller unit. Lofting deflector 410 includes inner portion 412 (closer to the axis of rotation) and outer portion 414. Lofting deflector 410 has an upwardly facing surface to loft particulate material to be impacted by impeller 420. In one embodiment, lofting deflector 410 is not only connected to impeller 420, but made integral with it. The making integral can be accomplished through the process of construction (e.g., bending it into place), or through fastening it together via a fastening means, or via welding).

In one embodiment, all arms of rotor element 400 (but not spacer 430) are formed from a single sheet of metal, with metal being cut and bent upward and/or downward into an essentially vertical position. As illustrated, the three impeller units are spaced circumferentially from one another by 120 degrees. In one embodiment, the arcuate length of the outer circular edge 414 of each support member/lofting deflector is 40 degrees. Referring to FIG. 4B, stacking one rotor element with another results in each vertical element being angularly offset in a circumferentially forward direction 40 degrees from the unit immediately above. Thus, a stack of nine rotor elements 400 would form three helixes, with each helix extending in a full 360 degrees around the center axis of rotation, located at the same level and spaced 120 degrees from each other.

Assembly 450 illustrates two stacked rotor elements, with lower element 404 being offset in a circumferentially forward direction 40 degrees from upper element 402. Spacer 462 separates elements 402 and 404, and spacer 464 would separate element 402 from another rotor element stacked on top of it. In the stacked configuration, impeller surfaces 472 and 474 are seen both facing circumferentially forward, even though surface 474 is 40 angular degrees ahead of surface 472. Lofting deflector surfaces 482 and 484 loft particulate material to be struck by either impeller surfaces 472 and 474, or potentially another surface in a rotor assembly (assuming more than two rotor elements are included in the rotor assembly).

In one embodiment, surface 406 is used to attach to another rotor element attached below element 404 (i.e., surface 406 attaches to the back side of an impeller impact surface). In an embodiment where element 404 is the bottom-most rotor element, surface 406 may be considered an impeller impact surface. In another embodiment, surface 406 would not exist on a bottom-most rotor element.

In one embodiment, each circumferentially forward facing surface includes a wear plate on its front surface, and the wear plate could be replaced with another wear plate as the surface gets worn. However, the use of a material sufficiently hard and/or durable with respect to the particulate material being used (e.g., manganese or manganese alloy with respect to steel grit) may sufficiently reduce the wear of the rotors to make the cost and hassle of wear plates not worth the effort.

The operation of assembly 450 could be understood with reference to element 402. When the particulate material is introduced into the operating chamber of which assembly 450 is a part, suppose the material is engaged by element 402 (the operation will be essentially identical regardless of which element of a rotor assembly is engaged, and regardless of which arm of the rotor element is engaged). The particulate material will make initial contact with either surface 472 or surface 482. If the particle first engages upward facing surface 482, the particle would likely be deflected upwardly and very quickly be impacted by the adjacent forward facing surface 472. Thus, the particle would have an upward component of travel when it is impacted by forward facing surface 472. Such an impact would project the particle in a circumferentially forward and upward direction.

If the particle first engages forward facing surface 472, it will likely either project circumferentially forward straight out or slightly downward direction, or will have a downward component of travel, in which case it would rebound upward facing surface 482, again travelling in a circumferentially forward direction with possibly an upward component of travel.

In one embodiment, the joint connecting the impeller to the lofting deflector is at a right angle, as illustrated by 492. Additionally, each rotor element 402, 404, is connected to the other at a right angle, as illustrated by 494. Other angles could be used, for example, if the lofting deflectors were set at an angle with respect to the axis of rotation, rather than being perpendicular to the axis of rotation.

Consistent with the above description, observation of a system in operation indicates that there is overall an upward travel path for a large percentage of the particles, causing an overall movement of the particles in a net upward direction of travel. The particles may possibly be projected in a downward direction after one or two impacts, but are generally projected back in an upward direction, with the overall direction being upward.

Additionally, it has also been found that the operation of device as described herein with continued impacting of the particles against the target surface that not only does the target surface get cleaned, but in some instances the blast processing device also accomplishes a surface treatment of the metal surface. More specifically, for certain types of steel surfaces which are being cleaned, the repetitive impacting of the particles will substantially raise the surface temperature of the steel surface being cleaned, and effect a surface treatment that would have beneficial results in various ways, such as inhibiting rust.

While it has been stated multiple times that the size and the number of the rotor elements can be adapted to a variety of sizes, one size that has been observed is a rotor element diameter of approximately 12 inches, with blade heights of approximately 1.5-3.0 inches. Such diameter and height dimensions could be varied upwardly and downwardly by values of 10%, 20%, 40%, 70%, 100%, 200%, 300%, 400%, or some other value (with the value applying to either increased or decreased dimensions).

Figure 5:
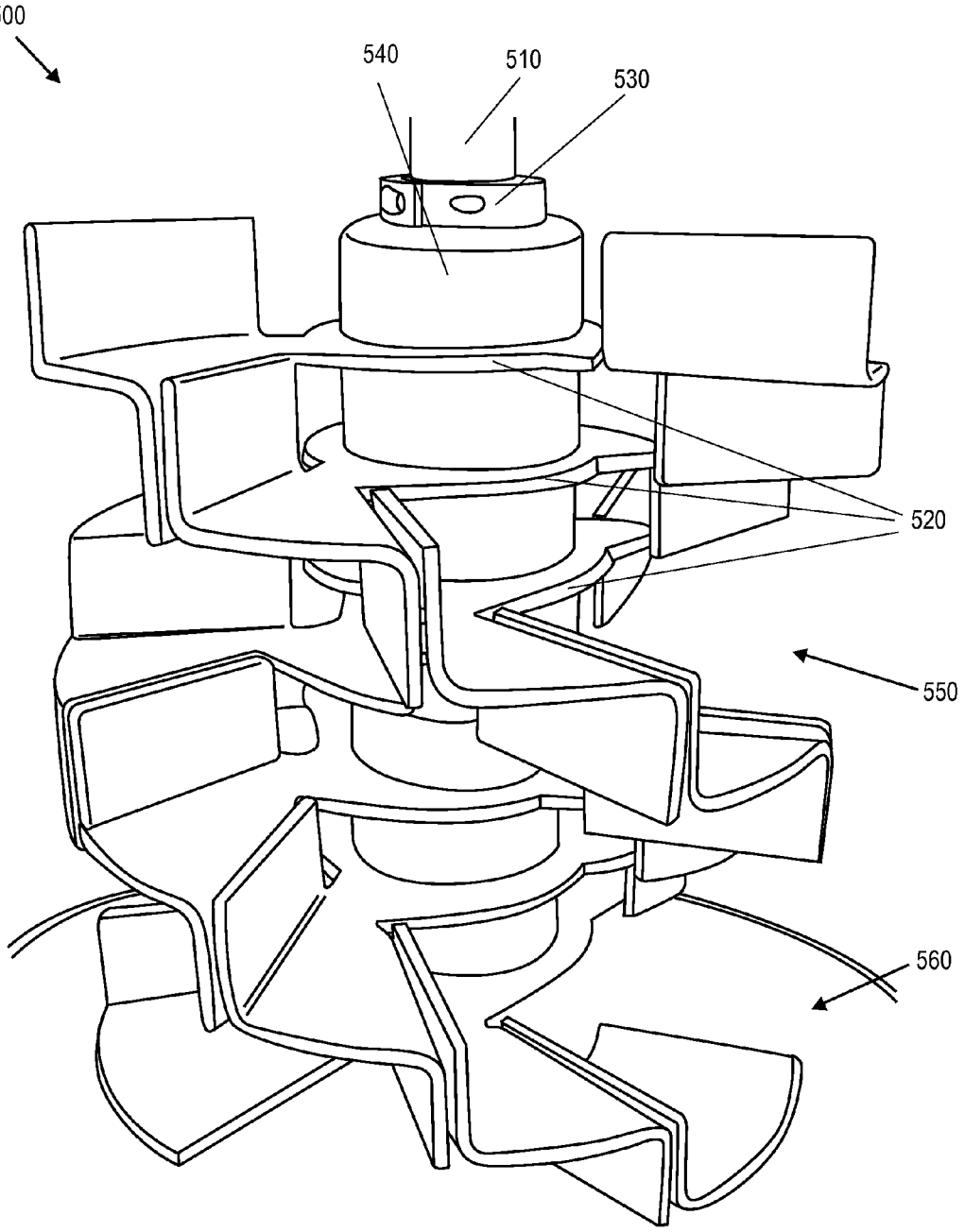
FIG. 5 illustrates a rotor assembly with lofting defectors to create a vortex and impellers to project blast material toward a target.

FIG. 5 illustrates a rotor assembly with lofting deflectors to create a vortex and impellers to project blast material toward a target. Similar to what is described above with respect to FIG. 4B, stacking rotor elements produces a helix. Rotor assembly 500 includes multiple (eight) rotor elements 520, with a bottom-most rotor element having an extended (double the number of angular degrees) lofting deflector.

Rotor elements 520 are connected together on shaft 510, separated by spacers 540, and locked into place with locking collar 530, which is a securing means that retains the components securely onto shaft 510.

The effect of having three arms allows three staircases in the helix. Each rotor element 520 includes generally planar impact surfaces. In the particular configuration illustrated, there are actually three helixes, which provides three series of rotor elements with associated impeller components, each rotor element series being arranged to make a single spiral or helix, having an overall configuration of a circular staircase.

As mentioned previously, the number of helix series can be increased or decreased, and the angular spacing of adjacent impeller components could be varied, as well as the arculate length of each of the horizontal members of rotor elements 520. Further, with impact members joining at upper and lower edges with adjacent edges, each series of joined rotor elements forms helix with a continuously stepped surface from the bottom to the top of the helix.

Also illustrated are operating chamber walls 550 and operating chamber base or lower portion 560 (e.g., the 'floor' of the operating chamber). In one embodiment, walls 550 are coated, lined, or made from a durable material such as manganese alloy, for durability of the device. Floor 560 may be made from a different material, seeing that it is not generally subject to the same impacts as the walls and rotor elements.

Figure 6B:
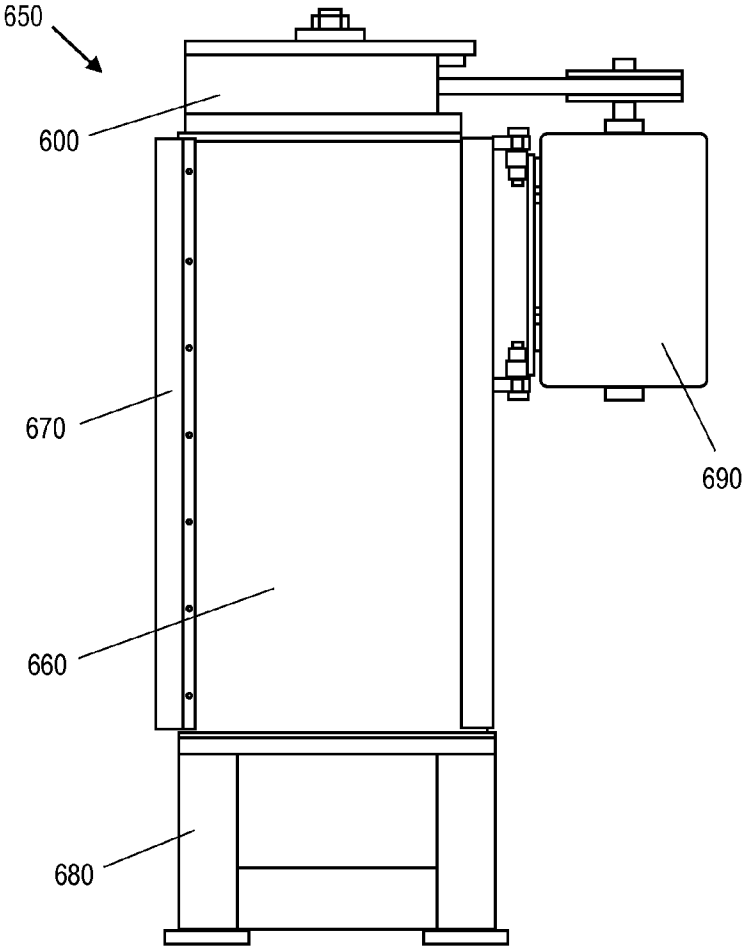
FIGS. 6A and 6B illustrate an embodiment of a rotor assembly that is enclosed within a blast chamber housing.
Figure 6A:
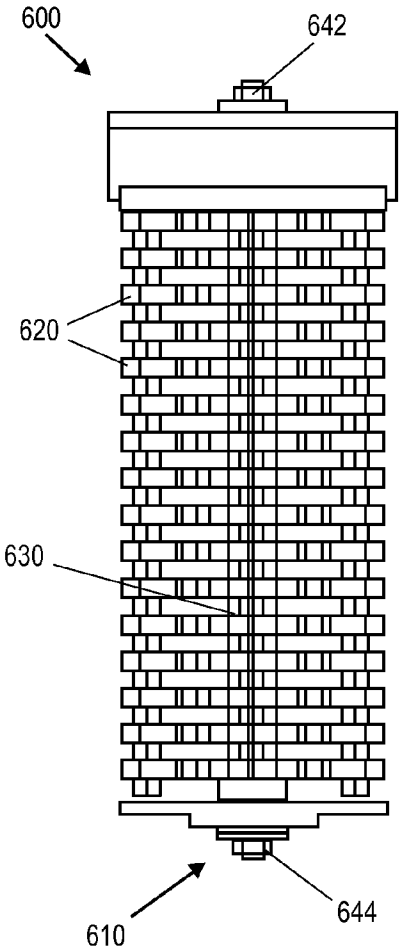

FIGS. 6A and 6B illustrate an embodiment of a rotor assembly that is enclosed within a blast chamber housing. Referring to FIG. 6A, assembly 600 illustrates an example of a side view of a rotor assembly. Rotor assembly 600 includes a plurality of rotor elements 620 axially aligned along shaft 610. Shaft 610 may be cylindrical, polygonal, and/or possess projections or grooves for retaining and/or aligning the rotor elements. Spacers 630 may be incorporated if necessary or desired for spacing and helping secure the rotor elements. Spacers 630 may also serve as couplers or similar affixing elements, depending upon a chosen configuration. Spacers 630 are shown between each rotor element 620, but other arrangements may be used. Fastening nuts 642 and 644, or other comparable securing or fastening mechanisms maintain secure configuration of rotor assembly 600. In one embodiment, shaft 610 is provided with threaded surfaces for engaged retention of nuts 642 and 644. Instead of nuts, other securing elements could be used that provide secure retention while allowing rapid disassembly and reassembly.

Referring to FIG. 6B, system 650 illustrates a side view of rotor assembly 600 mounted in blast chamber 660 having one or more seals 670. In one embodiment, support means 680 are provided to allow secure operation of system 650. In one embodiment, protective manganese or similar protective lining material along interior surfaces of blast chamber 660 provides device durability. Power source 690 provides a means for rotating rotor assembly 600 along the longitudinal axis of shaft 610 within blast chamber 660.

Seals 670 aid in preventing particulate media and cleaning debris from exiting blast chamber 660. Support means 680 provide stable and secure structure for positioning and configuration of system 650. Rotor assembly 600 is effectively rotated (spun) by power source 690. In one embodiment, power source 690 allows for a continuously variable range of rotational speeds, to allow flexibility of operation in accordance with application demands. Power source 690 may be one or more electrical motors, in association with appropriate operator controls and pulley or gear drive mechanisms as are generally understood.

Figure 7:
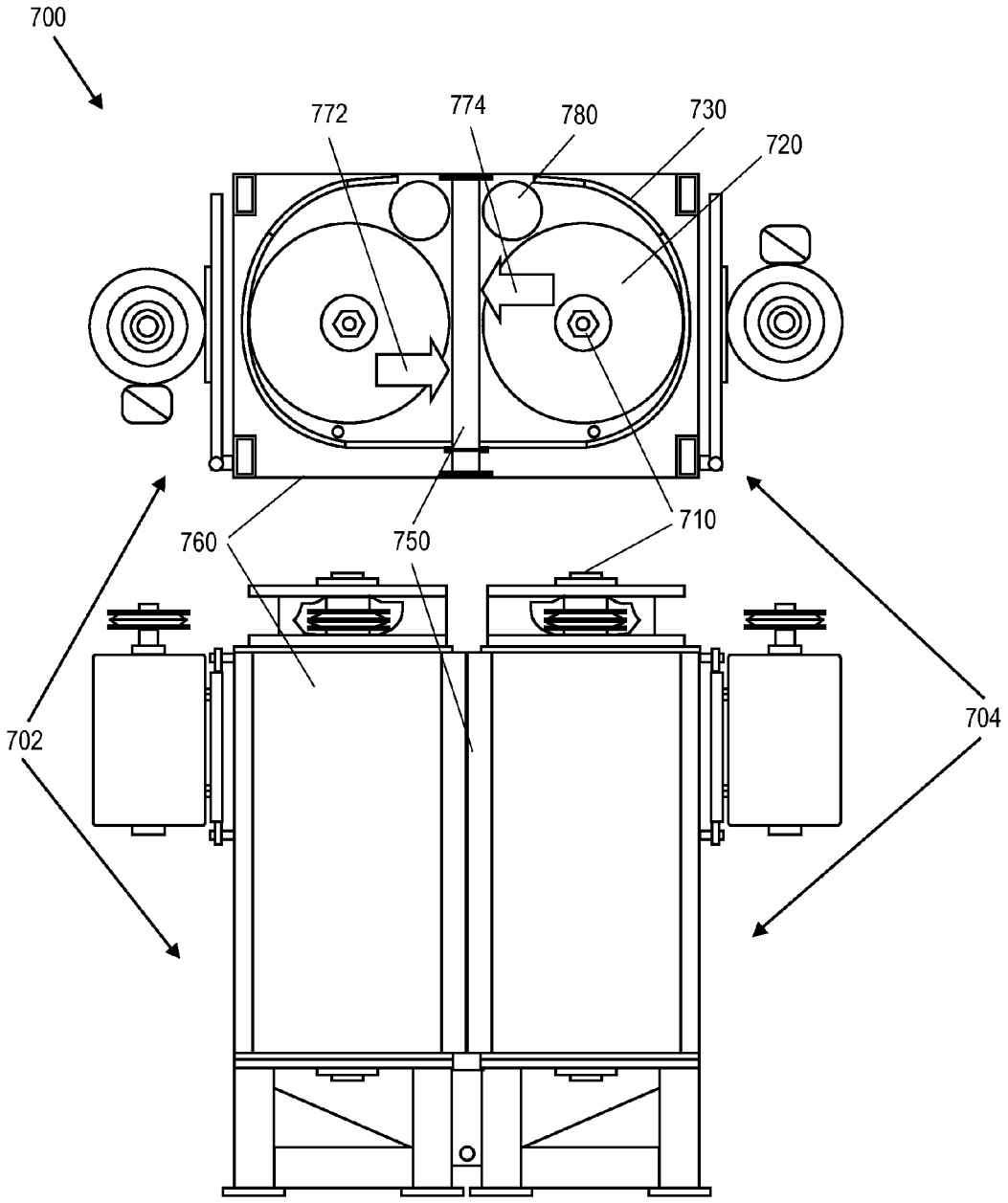
FIG. 7 illustrates side by side rotor assemblies having openings that face each other.

FIG. 7 illustrates side by side rotor assemblies having openings that face each other. System 700 shows top and side views of blast chamber assemblies 702 and 704 configured for cleaning full plate material. It will be understood that chamber assemblies 702 and 704 are not illustrated with space for angled deflectors in the respective directions of blast material projection, 772 and 774, respectively. Angled deflectors may or may not be part of the assemblies for applications involving processing plate materials. Thus, in one embodiment, angled deflectors are used in system 700, and in another embodiment they are not.

Seals 750 include associated target areas, which is where the angled deflectors would be located. Each assembly 702 and 704 includes an associated blast chamber housing, which may be further confined inside by insert 730 to form a smaller blast chamber area, constraining the space to conform more to a vortex space 720 in the respective blast chambers.

Seals 750 aid in preventing particulate media from escaping the blast chambers, particularly when a target work piece is not present. Vortex 720 is created by spinning rotor elements via shaft 710. It will be understood that the shaft for each of assemblies 702 and 704 can rotate the same way, and provide processing of a target run through seal 750 and associated target area. Both can spin the same way because of the fact that the openings are on facing sides of the blast chambers. Alternatively, assemblies 702 and 704 can be mirror images, and spin opposite directions.

The material to be cleaned may be advanced through seal 750 of system 700, or may be placed between the respective blast chambers of the two assemblies for stationary cleaning. Manual or automatic means may be applied to advance subject material through seal 750 and an associated target area. Mechanical, electric or hydraulic drive units may be employed to provide a selection of desired feed rates.

In one embodiment, when the abrasive media becomes sufficiently worn down, detectors notify system operators of the reduced power load and need for particulate material replacement. Excessively worn media is removed along with the waste material removed from the surface to be cleaned. In one embodiment, one or more waste removal conduits 780 extend inside the blast chamber and may employ negative pressure means (e.g., vacuum pump or venturi effect reduced pressure) to extract waste material and excessively worn media.

Figure 8:
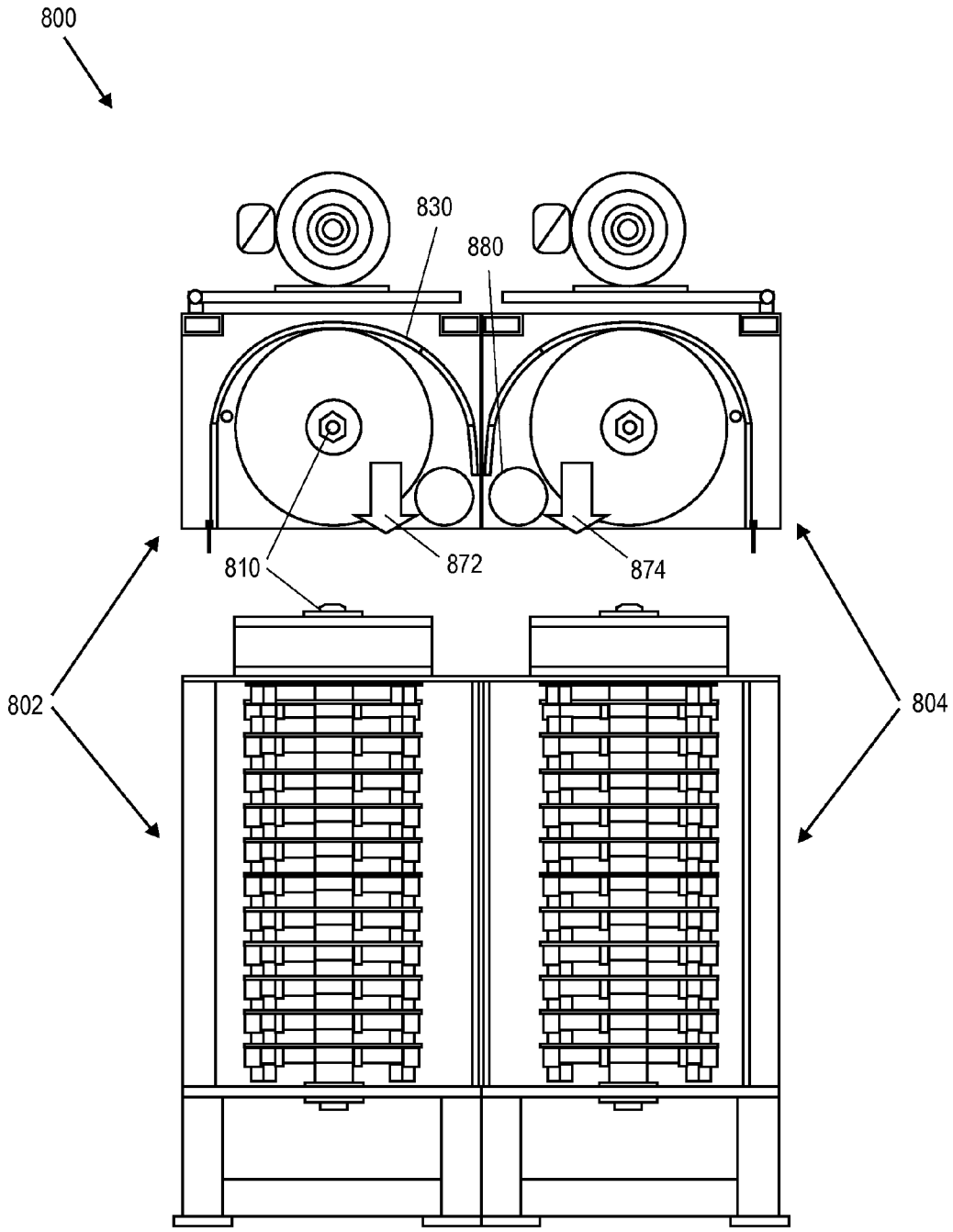
FIG. 8 illustrates side by side rotor assemblies having openings that face the same direction as each other.

FIG. 8 illustrates side by side rotor assemblies having openings that face the same direction as each other. System 800 includes two rotor assemblies 802 and 804 side by side, with openings facing the viewer. Thus, blast material would be ejected out the page at the viewer from the perspective of FIG. 8. It will be seen that directions of projected material 872 and 874 are the same for rotor assemblies 802 and 804, respectively.

Top and side views are provided, with a configuration for cleaning half plate material, or one side of a material. Similar to what is discussed previously, shaft 810 rotates its associated rotor assembly, which projects material out its opening. Insert 830 could be included to further enclose the space of the blast chamber. Again, angled deflectors may or may not be part of the assemblies for applications involving processing plate materials. Thus, in one embodiment, angled deflectors are used in system 700, and in another embodiment they are not. Additionally, one or more seals will be included, but is not shown. The direction of spin of each shaft could be the same or different.

In one embodiment, one or more waste removal conduits 880 extend inside the blast chamber and may employ negative pressure means (e.g., vacuum pump or venturi effect reduced pressure) to extract waste material and excessively worn media.

In one embodiment, the concepts of systems 700 and 800 can be combined. Thus, a system with four rotor assemblies can be configured, with two assemblies side by side pointing in the same direction as in system 800, and two more across from each one, as in system 700. Thus, for very difficult surfaces, two rotor assemblies can be provided for each surface side, both sides being done simultaneously, providing White Blast finish with hook profile in a single pass through the combined system.

Various components described herein may be a means for performing the operations or functions described. Besides what is described herein, various modifications may be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. An apparatus comprising:

a rotor assembly having a base and a top, the rotor assembly including:

a shaft, extending from the base of the rotor assembly to the top of the rotor assembly, that rotates about a longitudinal axis of the apparatus;

a first lofting deflector and a second lofting deflector coupled to the shaft, each having a face pointing to the top of the rotor assembly, in a direction substantially parallel to the longitudinal axis, the first and second lofting deflectors to create a vortex of air along the longitudinal axis as the shaft rotates, the vortex to move particulate material along the longitudinal axis in the direction of the top of the rotor assembly, wherein the first lofting deflector is angularly offset in a circumferential direction from the second lofting deflector and axially offset along the shaft in a longitudinal direction from the second lofting deflector; and a first impeller and a second impeller coupled to the shaft, each impeller adjacent to a corresponding one of the first lofting deflector and the second lofting deflector, each extending radially outward from the shaft, each having a face pointing in the direction of rotation of the shaft, each impeller to project the particulate material away from the axis; and an operating chamber having walls to enclose the rotor assembly along the longitudinal axis, and a bottom portion proximate the base of the rotor assembly and a top portions proximate the top of the rotor assembly to determine a vertical size of the operating chamber, the operating chamber having a target area opening in the walls through which the projected particulate material is directed toward a target.

2. The apparatus of claim 1, wherein the particulate material comprises 100% grit material.

3. The apparatus of claim 1, wherein the lofting deflectors and impellers are composed of a material including at least a portion of manganese.

4. The apparatus of claim 1, wherein the rotor assembly includes one impeller for each lofting deflector, and wherein the lofting deflector and the impeller are part of a single assembly.

5. The apparatus of claim 1, wherein the rotor assembly includes one impeller for each lofting deflector, and wherein the face of the lofting deflector is perpendicular to the face of the impeller.

6. The apparatus of claim 1, wherein the rotor assembly includes one impeller for each lofting deflector, and wherein a total number of lofting deflectors and impellers for the rotor assembly is adjustable, wherein a size of the operating chamber is correspondingly adjustable, depending on a size of the target.

7. The apparatus of claim 6, further comprising:

angled deflectors positioned at the target area to deflect the projected particulate material back into the operating chamber; and removably attachable seals connected to the angled deflectors at the target area, the seals having a size corresponding to the size of the target.

8. The apparatus of claim 1, further comprising angled deflectors removably connected to the operating chamber, to allow for the angled deflectors to be switched out for different size targets or for replacement due to wear.

9. The apparatus of claim 1, further comprising:

angled deflectors connected to the operating chamber at the target area to direct the projected particulate material through the opening toward the target, and to direct the projected particulate material back toward the rotor assembly to be lofted by the vortex to be subject to further projection, wherein the projected particulate material that strikes the target falls either back into the vortex to be subject to further projection, or strikes the deflector insert.

10. The apparatus of claim 1, further comprising:

a dynamometer coupled to a motor that rotates the rotor assembly, the dynamometer to indicate when a torque for rotating the rotor assembly falls below a threshold value.

11. The apparatus of claim 10, wherein the dynamometer comprises a current detector indicating a current drawn by the motor.

12. A system comprising:

first and second blast processing devices, each blast processing device including a rotor assembly having a base and a top, the rotor assembly including:

a shaft, extending from the base of the rotor assembly to the top of the rotor assembly, that rotates about a longitudinal axis of the blast processing device;

a first lofting deflector and a second lofting deflector coupled to the shaft, each having a face pointing to the top of the rotor assembly, in a direction substantially parallel to the longitudinal axis, the first and second lofting deflectors to create a vortex of air along the longitudinal axis as the shaft rotates, the vortex to move particulate material along the longitudinal axis in the direction of the top of the rotor assembly, wherein the first lofting deflector is angularly offset in a circumferential direction from the second lofting deflector and axially offset along the shaft in a longitudinal direction from the second lofting deflector; and a first impeller and a second impeller coupled to the shaft, each impeller adjacent to a corresponding one of the first lofting deflector and the second lofting deflector, each extending radially outward from the shaft, each having a face pointing in the direction of rotation of the shaft, each impeller to project the particulate material away from the longitudinal axis;

an operating chamber having walls to enclose the rotor assembly along the longitudinal axis, and a bottom portion proximate the base of the rotor assembly and a top portions proximate the top of the rotor assembly to determine a vertical size of the operating, the operating chamber having a target area opening in the walls through which the projected particulate material is directed toward a target; and angled deflectors connected to the operating chamber at the target area to direct particulate material projected through the opening toward a target, and to direct the projected particulate material back toward the rotor assembly to be lofted by the vortex to be subject to further projection, wherein the projected particulate material that strikes the target falls either back into the vortex to be subject to further projection, or strikes the deflector insert;

wherein the first and second blast processing devices are positioned adjacent to each other, and process the same target.

13. The system of claim 12, wherein the first and second blast processing devices are positioned with target area openings facing each other, to concurrently process the same target from opposing directions.

14. The system of claim 12, wherein the first and second blast processing devices are positioned side-by-side with target area openings pointing in the same direction, to process the same target from the same direction.

15. An apparatus comprising:

a rotor assembly having a base and a top, the rotor assembly including:

a shaft, extending from the base of the rotor assembly to the top of the rotor assembly, that rotates about a longitudinal axis of the apparatus;

a first lofting deflector and a second lofting deflector coupled to the shaft, each having a face pointing to the top of the rotor assembly, in a direction substantially parallel to the longitudinal axis, the first and second lofting deflector to create a vortex of air along the longitudinal axis as the shaft rotates, the vortex to move particulate material along the longitudinal axis in the direction of the top of the rotor assembly, wherein the first lofting deflector is angularly offset in a circumferential direction from the second lofting deflector and axially offset along the shaft in a longitudinal direction from the second lofting deflector; and a first impeller and a second impeller coupled to the shaft, each impeller adjacent to a corresponding one of the first lofting deflector and the second lofting deflector, each extending radially outward from the shaft, each having a face pointing in the direction of rotation of the shaft, each impeller to project the particulate material away from the longitudinal axis; and an operating chamber proximate the rotor assembly to enclose the rotor assembly in an area in which the vortex is created along the longitudinal axis, the operating chamber having a target area opening through which the projected particulate material is directed toward a target.

16. The apparatus of claim 15, wherein the operating chamber comprises an insert that at least partially defines the area in which the vortex is created.

17. The apparatus of claim 16, wherein the operating chamber comprises a housing that encloses the insert.

18. The apparatus of claim 17, wherein the housing comprises walls that enclose the insert, and a bottom portion proximate the base of the rotor assembly and a top portion proximate the top of the rotor assembly to determine a vertical size of the operating chamber.

* * * * *